United States Patent [19]

Nakajima et al.

[11] 4,158,287

[45] Jun. 19, 1979

[54] DRIVER CIRCUIT FOR ELECTRO-MECHANICAL TRANSDUCER

[75] Inventors: Fumio Nakajima, Tokyo; Takayasu Machida, Iruma; Kenji Yamada, Koganei, all of Japan

[73] Assignee: Citizen Watch Company Limited, Tokyo, Japan

[21] Appl. No.: 821,433

[22] Filed: Aug. 3, 1977

[30] Foreign Application Priority Data

Aug. 12, 1976 [JP] Japan ..... 51-96405
Jan. 13, 1977 [JP] Japan ..... 52-2679

[51] Int. Cl.[2] ..... G04C 3/00

[52] U.S. Cl. ..... 58/23 BA; 58/23 A; 58/23 D; 58/152 H; 318/139; 340/636; 340/663

[58] Field of Search ..... 58/23 R, 23 A, 23 BA, 58/23 D, 152 B, 152 H; 340/248 B, 249, 636, 663; 318/139

[56] References Cited

U.S. PATENT DOCUMENTS

| | | | |
|---|---|---|---|
| 3,943,380 | 3/1976 | Morgan et al. | 58/23 A X |
| 3,949,545 | 4/1976 | Chihara | 58/23 BA |
| 4,014,164 | 3/1977 | Fujita | 58/23 BA |

*Primary Examiner*—Stanley J. Witkowski
*Attorney, Agent, or Firm*—Frank J. Jordan

[57] ABSTRACT

An electro-mechanical transducer driver circuit for an electronic timepiece characterized in that the pulse width of a driving pulse which drives an electro-mechanical transducer is controlled in a step-wise manner by the induced voltage of a driving coil.

7 Claims, 15 Drawing Figures

DRIVER CIRCUIT FOR ELECTRO-MECHANICAL TRANSDUCER

This invention relates to driver circuits for electro-mechanical transducers and, more particularly, to a driver circuit for a stepping motor of an electronic timepiece.

In recent years, balance wheels with hairsprings and stepping motors which rotate stepwise in a given direction, both of these components being controlled by the divided signals obtained from a crystal controlled oscillator, have come into practical use in electro-mechanical transducers for electronic timepieces. In general, transducers of this type for use in wristwatches became unstable when subjected to an impact load although it has been proposed to enhance impact resistance in single-phase pulse drive systems by using the driving coil induced voltage to control the width of the driving pulses. In part, such systems have come into use. At the same time, however, problems still remain in the single phase drive system. When a balance wheel with hairspring is used, the driving pulses are applied to the driving coil only when the balance wheel is rotated in one direction so that malfunction is still likely even if the pulse width is widened upon impact. The multiphase stepping motor, on the other hand, is a multipolar structure in which the induced voltage becomes too small due to a decrease in the step-wise angles of rotation. Sufficient control, and therefore satisfactory stability, cannot be obtained. In addition, mercury oxide batteries have come into use as power sources for wristwatches. Although these batteries are quite suited for use in the electronic timepiece owing to their stability at normal temperatures, batteries which make use of NaOH dissolved in a solution exhibit poorer characteristics at low temperatures, and there is a marked drop in battery voltage due to an increase in internal resistance. In order to keep the stepping motor operating, the width of the stepping motor driving pulses is set to be fairly wide so as to assure reliable operation even when the battery voltage drops due to the influence of low temperatures. Since this results in wasteful power consumption during normal operation, a battery with a large current capacity is required, battery lifetime is shortened, and a reduction in overall timepiece size cannot be easily obtained since it must be large enough to accommodate the battery of the afore-mentioned type which possesses a rather thick cross-section.

It is, therefore, an object of the present invention to provide a highly stable transducer driver circuit which is not beset by the afore-mentioned defects.

It is another object of the present invention to provide a highly stable driver circuit for an electro-mechanical transducer to be used in an electronic timepiece, the driver circuit characterized in that the pulse width of a two phase driving pulse which drives an electro-mechanical transducer is controlled in a step-wise manner by the induced voltage of a driving coil.

It is a further object of the present invention to provide a driver circuit for a transducer which eliminates the necessity for a battery having a large current capacity, thereby making it possible to reduce the overall size of a timepiece.

It is a still further object of the present invention to provide an electro-mechanical transducer driver circuit characterized in that the width of a pulse for driving the driver circuit is varied step-wise in response to variations in power source voltage.

Another object of the invention is to provide an electro-mechanical transducer for a timepiece characterized in that the change-over circuit, in response to an output signal from the voltage detection circuit, changes over the input pulses applied to the wave shaping circuit.

Figure 1A:
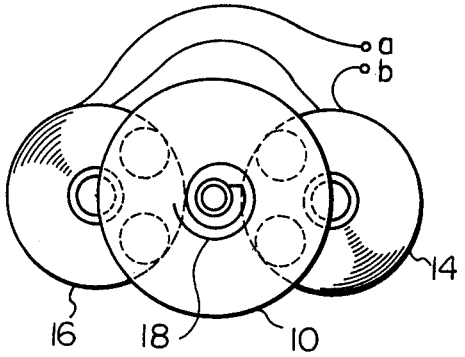
FIG. 1A and FIG. 1B are respective plan and side views showing an example of a balance wheel with hairspring which serves as an electro-mechanical transducer.
Figure 1B:
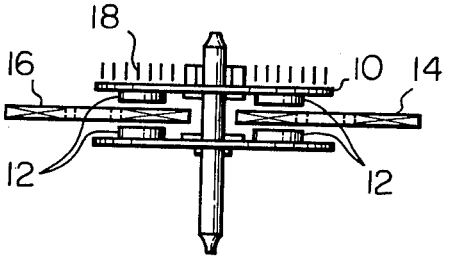

FIGS. 1A and 1B show one example of an electro-mechanical transducer in which reference numeral 10 denotes a balance wheel, 12 a magnet, 14, 16 driving coils, 18 a hairspring, and a and b driving coil terminals. A magnetic field produced by the driving coils in response to an electric current generated by a two-phase pulsed voltage applied to the terminals a, b causes the balance wheel with hairspring to undergo reciprocal movement owing to the balance wheel magnet which is subjected to a force resulting from the production of the magnetic field.

Figure 2:
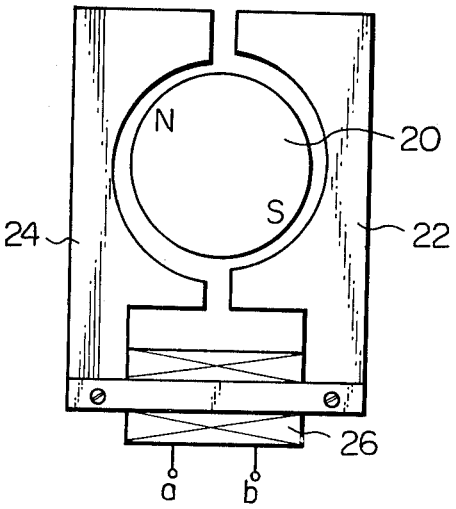
FIG. 2 is a plan view showing another example of a stepping motor which serves as an electro-mechanical transducer.

FIG. 2 shows another example of an electro-mechanical transducer in which reference numeral 20 denotes a rotor comprising a magnet having at least two magnetic poles 22, 24 denote stators which are composed of a magnetic material, 26 denotes a driving coil, and a, b denote driving coil terminals. These components constitute a stepping motor in which the rotor is rotated stepwise in a given direction by means of a magnetic flux generated by the driving coil in response to alternating electric current pulses generated by a two-phase pulsed voltage applied to the terminals a, b, the flux being transmitted through the stators 22, 24.

Figure 3:
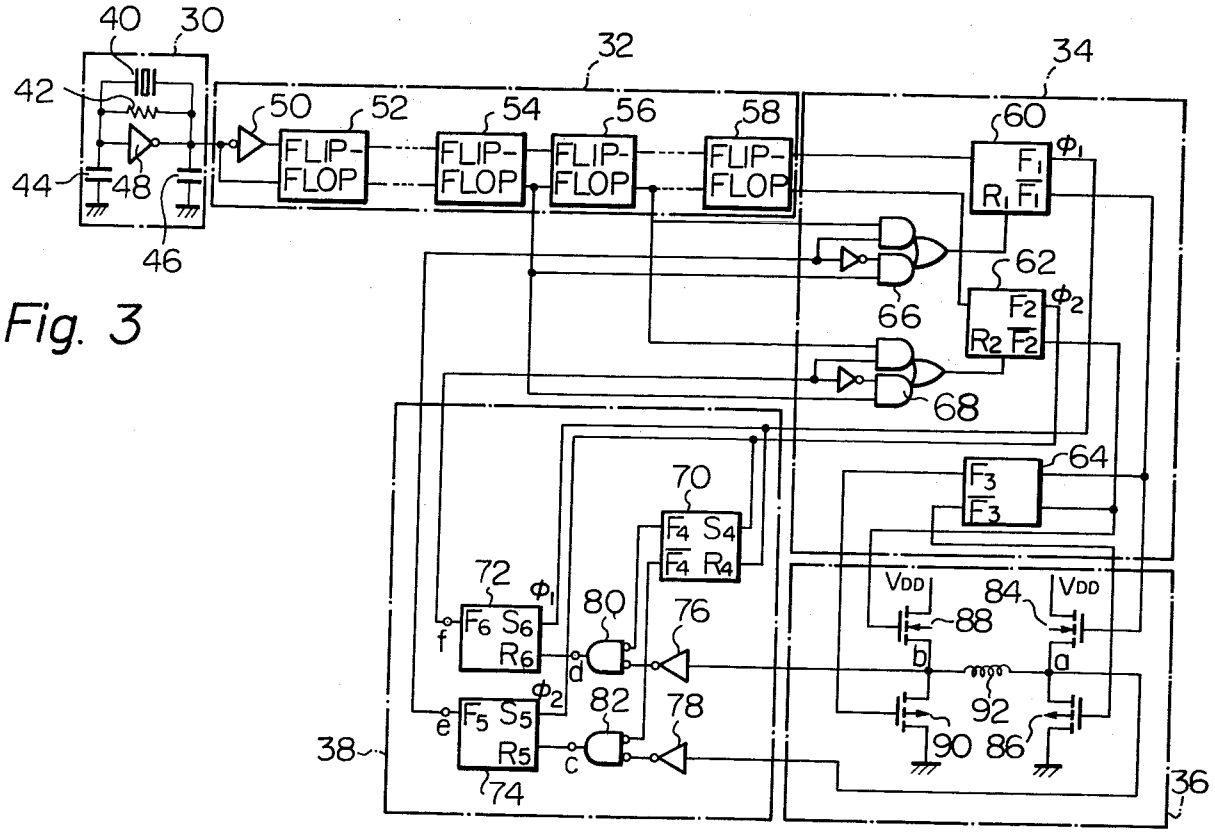
FIG. 3 is a circuit diagram of a preferred embodiment of an electro-mechanical transducer driver circuit in accordance with the invention.
Figure 4:
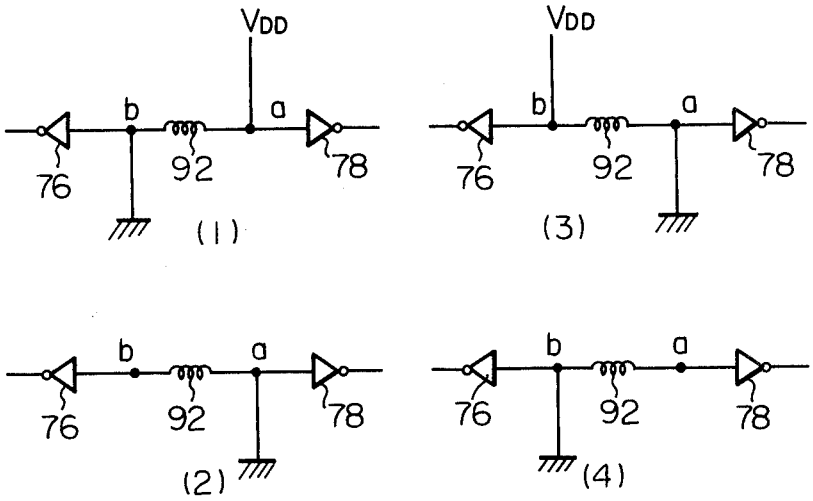
FIG. 4 is a view useful in explaining the state of a driving coil.
Figure 5:
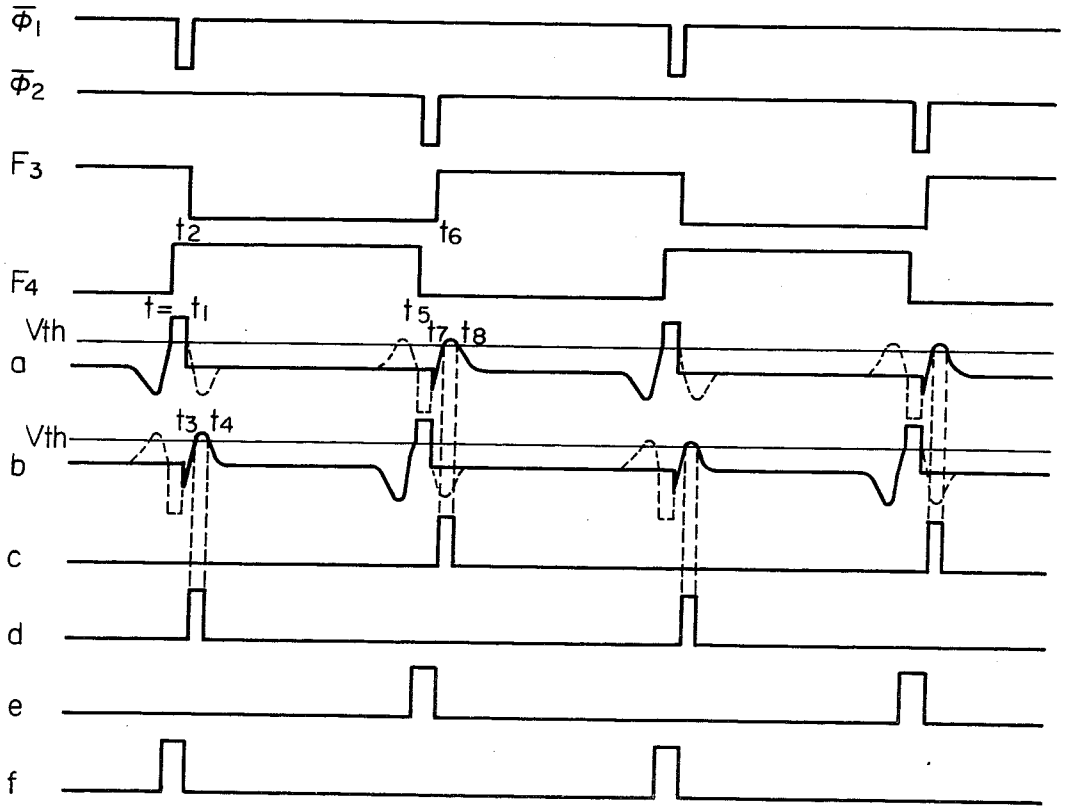
FIG. 5 and FIG. 6 are wave diagrams for a case in which a balance wheel with hairspring is employed as an electro-mechanical transducer.
Figure 6:
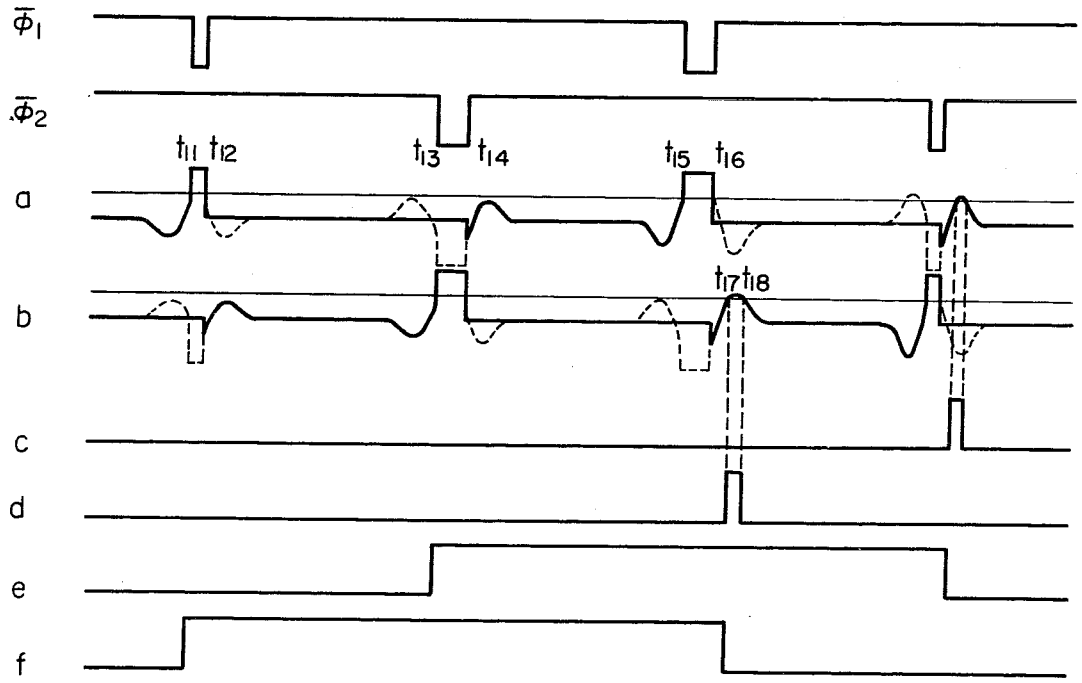
Figure 7:
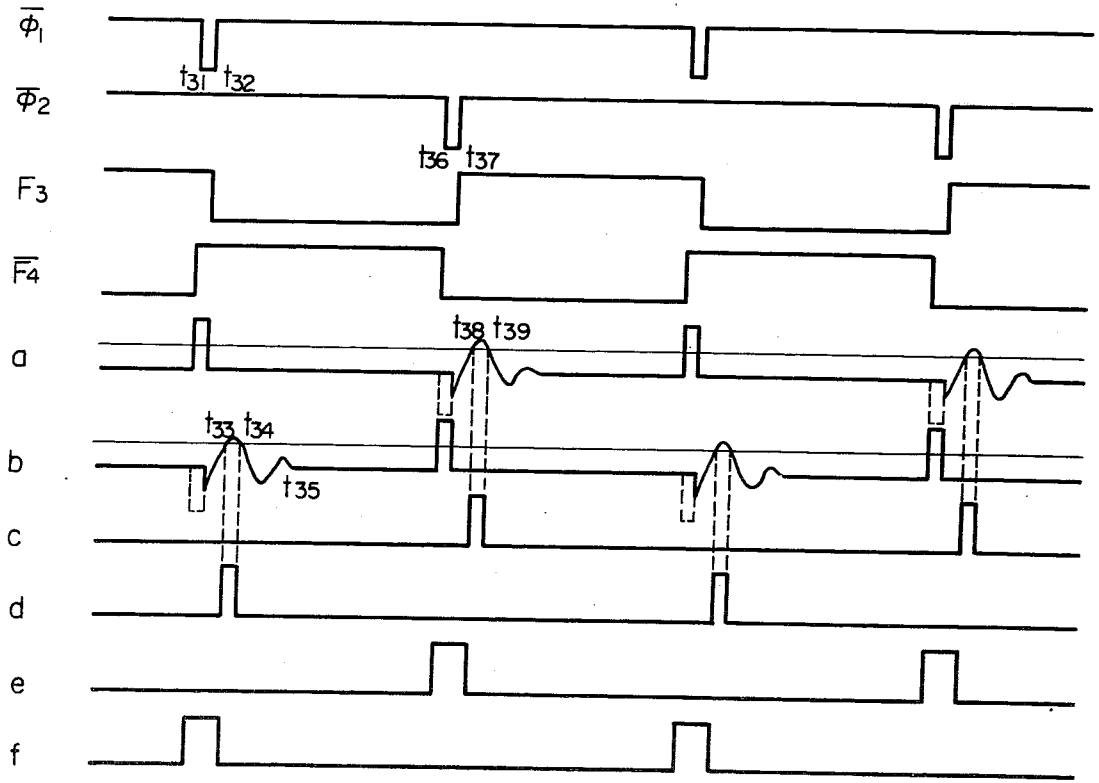
FIG. 7 and FIG. 8 are wave diagrams for a case in which a stepping motor is employed as an electro-mechanical transducer.
Figure 8:
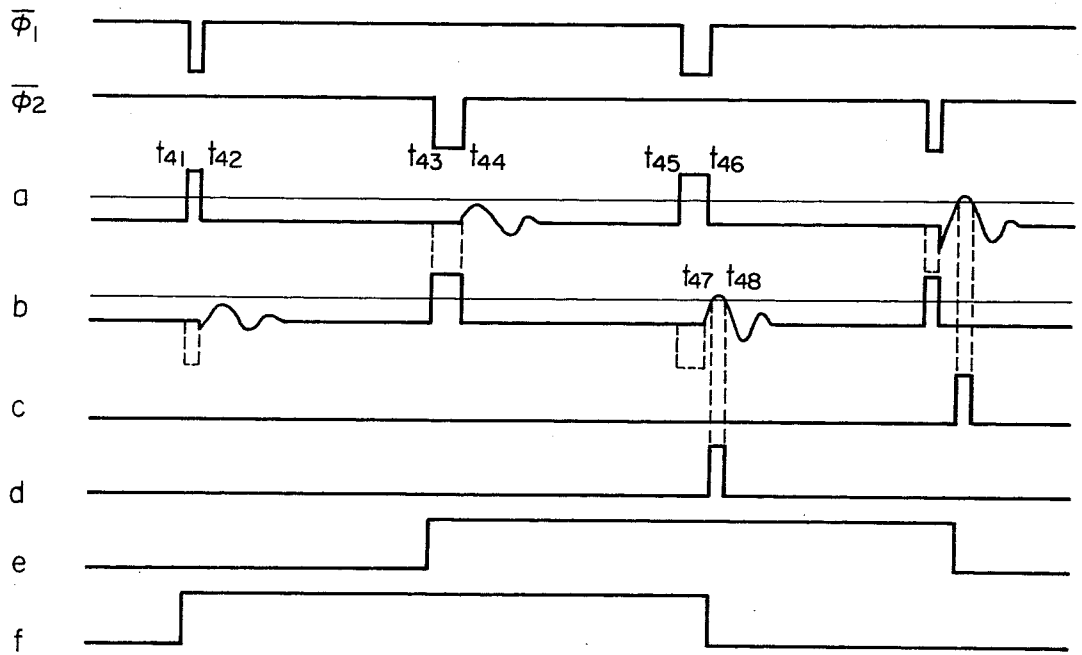

FIG. 3 shows a circuit diagram of an electro-mechanical transducer driver circuit in accordance with the invention, in which reference numeral 30 designates a crystal controlled oscillator, 32 a frequency divider, 34 a pulse width change-over circuit, 36 a driver circuit, and 38 a detector-memory circuit. FIG. 4 is a drawing useful in explaining the states of the driving coils, FIG. 5 and FIG. 6 show the relevant waveforms for a case in which the balance wheel with hairspring is employed as the electro-mechanical transducer, FIG. 5 showing the waveforms for normal operation, and FIG. 6 showing the waveforms during impact. FIG. 7 and FIG. 8 show the relevant waveforms for a case in which the pulse motor is employed as the electro-mechanical transducer, FIG. 7 showing the waveforms for normal operation, and FIG. 8 showing the waveforms during impact.

With reference to FIG. 3, the oscillator 30 comprises a quartz crystal 40, a resistor 42, capacitors 44, 46, and inverter 48, which are connected in a well known manner to provide a relatively high frequency signal of, for example, 32,768 Hz. This relatively high frequency signal is applied to the frequency divider 32, which are composed of an inverter 50, and a plurality of flip-flops 52 to 58. Output signals obtained from flip-flops (hereafter referred to as FF) 54, 56 of frequency divider 32 are applied to the input sides of frequency change-over circuits 66, 68 which, during normal operation, deliver output signals to the reset terminals of FF 60, 62, respectively, so that pulse signals $\phi 1$, $\phi 2$ having a short pulse width appear alternatively at output terminals F1, F2. F1 is connected to terminal R4 of reset-set flip-flop (hereafter referred to as RS-FF 70 and terminal S6 of RS-FF 72 which serves as a memory circuit. F2 is connected to terminal S4 of RS-FF 70 and terminal S5 of RS-FF 74 which also serves as a memory circuit. The other output terminal $\overline{F1}$ of FF 60 is connected to one input terminal of FF 64 and the P-channel MOS transistor (hereafter referred to as P-ChMOS transistor) 84, while the other output terminal $\overline{F2}$ of FF 62 is connected to the other input terminal of FF 64 and the gates of P-ChMOS transistor 88. The output terminal F3 of FF 64 is connected to N-Channel MOS transistor (hereafter referred to an N-ChMOS transistor) 90, while terminal $\overline{F3}$ is connected to the gates of N-ChMOS transistor 86. Driving coil 92 is connected between the common drains a, b of the MOS transistors, with terminal a being connected to induced voltage detection inverter 78, and terminal b to the input gates of induced voltage detection inverter 76. The output side of inverter 76 is connected to terminal R6 of FF 72 through gate 80, and the output side of inverter 78 is connected to terminal R5 of FF 74 through gate 82. Finally, the output terminal F6 of FF 72 and the output terminal F5 of FF 74 are connected to the input sides of respective frequency change-over circuits 66, 68.

In operation, the balance wheel with hairspring will first be considered. Referring to FIG. 5, pulse $\phi 1$ appears at $t=t_1$, and P-ChMOS transistor 84 is turned on. At this time, since F3=1, N-ChMOS transistor 90 is conductive; hence, the state of the driving circuit is as illustrated in FIG. 4(1), and the balance wheel with spring is subjected to a driving force due to the electric current which flows from a to b as a result of the driving voltage applied to terminal a. When the pulse is removed at $t=t_2$, F3 assumes a "0" logic level and $\overline{F3}$ a "1" logic level, so that P-ChMOS transistor 84 and N-Ch MOS transistor 90 are turned off and N-Ch MOS transistor 86 is turned on, yielding the state shown in FIG. 4(2). Since terminal a is grounded through transistor 84 and the signal which appears at the terminal is a illustrated in FIG. 5(*a*), induced voltage detection inverter 78 is inoperative. On the other hand, although terminal b is connected to ground when the pulse is applied, the grounded condition is overcome immediately after the pulse is removed and the induced voltage is applied to inverter 76; at $t=t_3\sim t_4$, the induced voltage exceeds the threshold voltage of the inverter so that the gate circuit 80 produces an output d. Gate circuits 80, 82 are provided for the purpose of delivering only the excitation voltage to the reset terminals of FF 72, 74.

Next, pulse $\phi 2$ appears at $t=t_5$, and P-Ch MOS transistor 88 is turned on. Since N-Ch MOS transistor 86 remains on, the state of the driving circuit is as illustrated in FIG. 4(3); hence, the balance wheel with hairspring is subjected to a driving force acting in the reverse direction due to the electric current which flows from b to a as a result of the driving voltage applied to terminal b. When the pulse is removed at $t=t_6$, F3 assumes a "1" logic level and $\overline{F3}$ a "0" logic level so that P-Ch MOS transistor 88 and N-Ch MOS transistor 86 are turned off and transistor 90 is turned on, yieldng the state shown in FIG. 4(4). Since terminal b is grounded through transistor 90 and the signal which appears at the terminal is as illustrated in FIG. 5(*b*), induced voltage detection inverter 76 is inoperative. On the other hand, although terminal b is connected to ground when the pulse is applied, the grounded condition is overcome immediately after the pulse is removed and the induced voltage is applied to inverter 78; at $t=t_7\sim t_8$, the induced voltage exceeds the threshold voltage of the inverter so that the gate circuit 82 produces an output c. Memory circuit 74 upon being set by $\phi 2$ and reset by c produces a signal e which assumes an "0" logic level The output of frequency change-over circuit 66 thus follows the output of FF 54, and $\phi 1$ becomes a pulse having a narrow pulse width. Further, memory circuit 72, upon being set by $\phi 1$ and reset by d, produces a signal f which assumes a "0" logic level. The output of frequency change-over circuit 68 thus follows the output of FF 54, and $\phi 2$ becomes a pulse having a narrow pulse width.

Reference will now be had to FIG. 6 for a case in which an impact load is sustained. Specifically, the output f of memory circuit 72 is reset to a logic level of "1" by $\phi 1$ and remains at that level since no reset pulse is generated owing to the fact that the induced voltage has decreased and no longer exceeds the threshold voltage. Thus, frequency change-over circuit 68 is changed-over, the output of FF 56 is applied to terminal R2 of FF 62, and the pulse width of $\phi 2$ is doubled ($t_{13}\sim t_{14}$). Further, the output of memory circuit 74 is reset to "1" by $\phi 2$, and e remains at a logic level of "1" since no reset pulse is generated. Thus, frequency change-over circuit 66 is changed-over, the output of FF 56 is applied to terminal R1 of FF 60, and the pulse width of $\phi 1$ is doubled ($t_{15}\sim t_{16}$). It will thus be seen that the pulse width change-over circuit provides first driving pulses of a first pulse width when the induced voltage is above a predetermined value and provides second drive pulses of a second pulse width greater than the first pulse width to compensate for a decrease in the induced voltage when the induced voltage decreases below the predetermined value. When the induced voltage returns to its previous state after the pulse widths have been doubled and the driving power increased, a reset pulse appears at d at $t=t_{17}\sim t_{18}$, f attains a "0" logic level, and both pulses $\phi 2$, $\phi 1$ return to their previous states.

Operation for a case in which a pulse motor is adopted will now be described with reference to FIG.

7. Although the induced voltage waveforms are somewhat different, there are substantially no other difference from the case in which the balance wheel with hairspring was employed. At $t=t_{31}$, pulse $\phi 1$ appears, a driving voltage is applied to terminal a of the driving coil, and the resulting current flows from a to b thereby exciting stators 22, 24. In consequence, rotor 20 is rotated through 180° in the clockwise direction. Immediately after $\phi 1$ is removed, terminal a is connected to ground and terminal b disconnected from ground so that the induced voltage which accompanies the rotation of the rotor is applied to inverter 76. Thus, at $t=t_{33}\sim t_{34}$, the induced voltage exceeds the threshold voltage of the inverter, whereby gate circuit 80 produces an output d. The output f of memory circuit 72 returns to a "0" logic level, and $\phi 2$ becomes a pulse having a narrow pulse width. At $t=t_{35}$, the rotor is substantially at a point of static equilibrium.

Next, pulse $\phi 2$ appears at $t=t_{36}$, a driving voltage is applied to terminal b of the driving coil, and the resulting current flows from b to a thereby exciting the stators in the reverse direction so that the rotor rotates through 180° in the same direction as the previous case. At $t=t_{37}$, upon removal of the pulse, terminal b is connected to ground and terminal b disconnected from ground so that the induced voltage is applied to inverter 78. Thus, at $t=t_{38}\sim t_{39}$, the induced voltage exceeds the threshold voltage, whereby gate 82 produces an output c. Memory circuit 74 upon being set by $\phi 2$ and reset by c produces a signal e which assumes an "0" logic level. The output of frequency change-over circuit 66 thus follows the output of FF 54, and pulse $\phi 1$ having a narrow pulse width. Further, memory circuit 72 upon being set by $\phi 1$ and reset by d produces a signal f which assumes a "0" logic level. The output of frequency change-over circuit 68 thus follows the output of FF 54, and $\phi 2$ becomes a pulse having a narrow pulse width.

Reference will now be had to FIG. 8 for a case in which an impact load is sustained. The output f of memory circuit 72 is set to "1" by $\phi 1$ and remains set at that level since a reset pulse is no longer generated owing to the fact that the induced voltage has decreased and no longer exceeds the threshold voltage. Thus, frequency change-over circuit 68 is changed over, the output of FF 56 is applied to terminal R2 of FF 62, and the pulse width of $\phi 2$ is doubled ($t_{43}\sim t_{44}$). Further, the output e of memory circuit 74 is reset to "1" by $\phi 2$, and frequency change-over circuit 66 is changed over. Thus, the output of FF 56 is applied to terminal R1 of FF 60, and the pulse width of $\phi 1$ is doubled, thereby increasing the driving power. This prevents timepiece malfunction. If the load falls to zero, the induced voltage returns to its previous state, a reset pulse appears at d, f attains a "0" logic level, and both pulses $\phi 1$, $\phi 2$ return to their previous states.

When the balance wheel with hairspring is employed, an excitation voltage is produced directly before and directly after a driving pulse so that either may be used to control pulse width. In the case of the stepping motor, however, the excitation voltage is produced only after the driving pulse.

Figure 12:
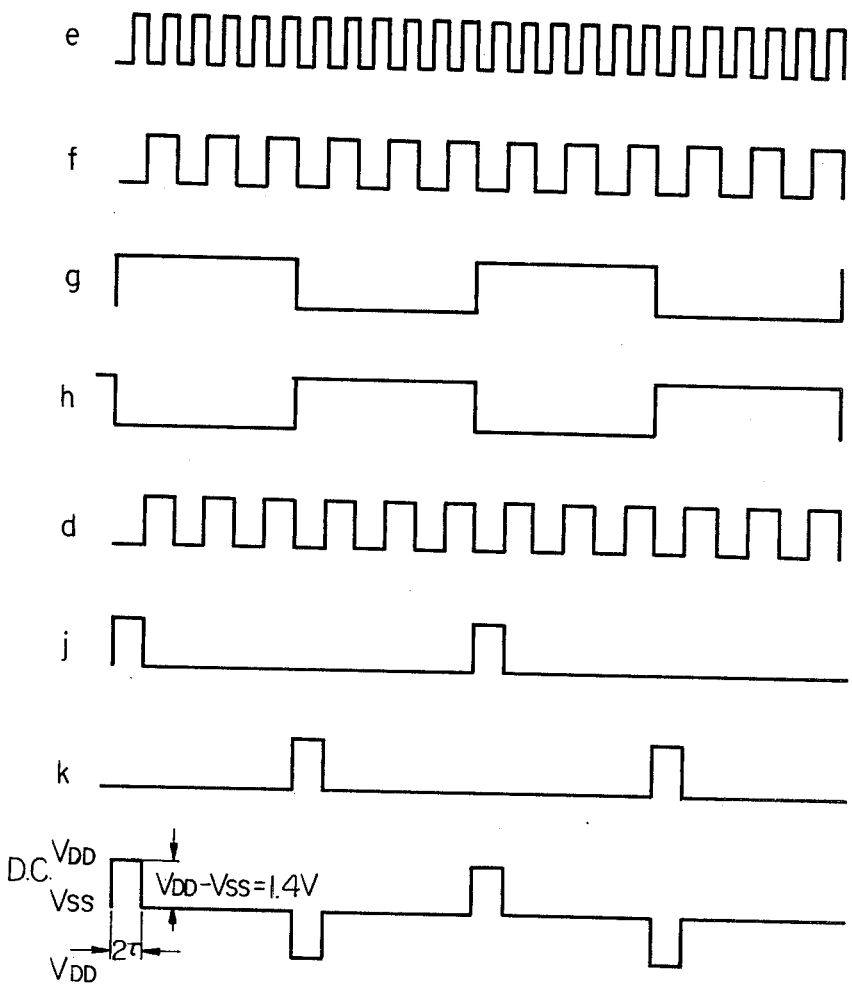
FIG. 12 shows waveforms for operation when there is a drop in battery voltage.

In accordance with the invention, the transducer is driven by a driving pulse having a minimum necessary pulse width of 5 milliseconds or less during normal operation as shown in FIG. 12 to compensate for a drop in the output voltage of the battery, whereas the pulse width is increased beyond this value when the transducer is subjected to an impact load. Accordingly, driving power which surmounts the impact is applied to the transducer so as to preclude malfunction. If the impact load is removed, the width of the pulse once again drops below 5 milliseconds so that it is possible to hold consumption of current to an average of less than 1 $\mu$A. Furthermore, since the driving coil excitation voltage is detected by a CMOS inverter, it is not necessary to adopt a detection mechanism in which the transducer is especially provided with a detection coil or, in which the wheel train connected to the transducer is provided with either a contact of semi-conductor element. Since there is no need for detection of driving current, an amplifier is unnecessary and consumption of current can be ignored. As a result, the overall current required by the oscillator and frequency divider can be held to less than 2 $\mu$A.

Although the embodiment described above adopts a driving pulse width which, upon impact, is double the pulse width during normal operation, the pulse width can be increased in a step-wise fashion to any desired value. Finally, it should also be apparent that the present invention can be applied to control pulse width in cases where there are load variations produced by causes other than impact. For example, it may be applied to situations where a load variation is caused by driving a calendar display.

Figure 9:
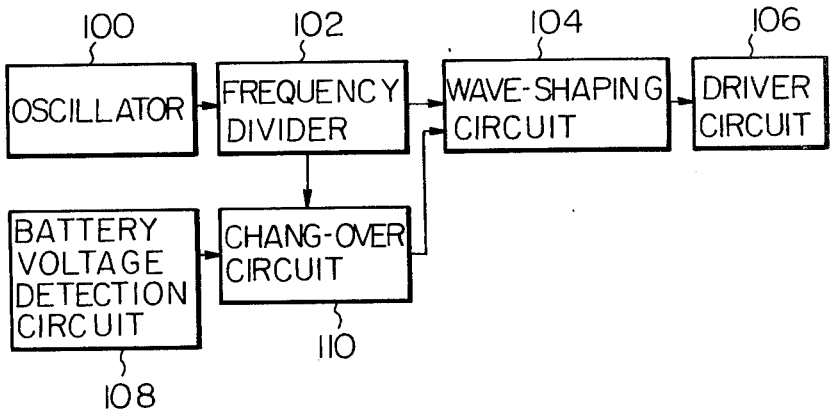
FIG. 9 is a block diagram of another preferred embodiment of an electro-mechanical transducer driver circuit in accordance with the present invention.

FIG. 9 shows a block diagram of another preferred embodiment of a driving circuit in accordance with the present invention, in which reference numeral 100 designates an oscillator, 102 a frequency divider, 104 a wave shaping circuit, 106 a driver circuit, 108 a battery voltage detection circuit, and 110 a change-over circuit.

Figure 10:
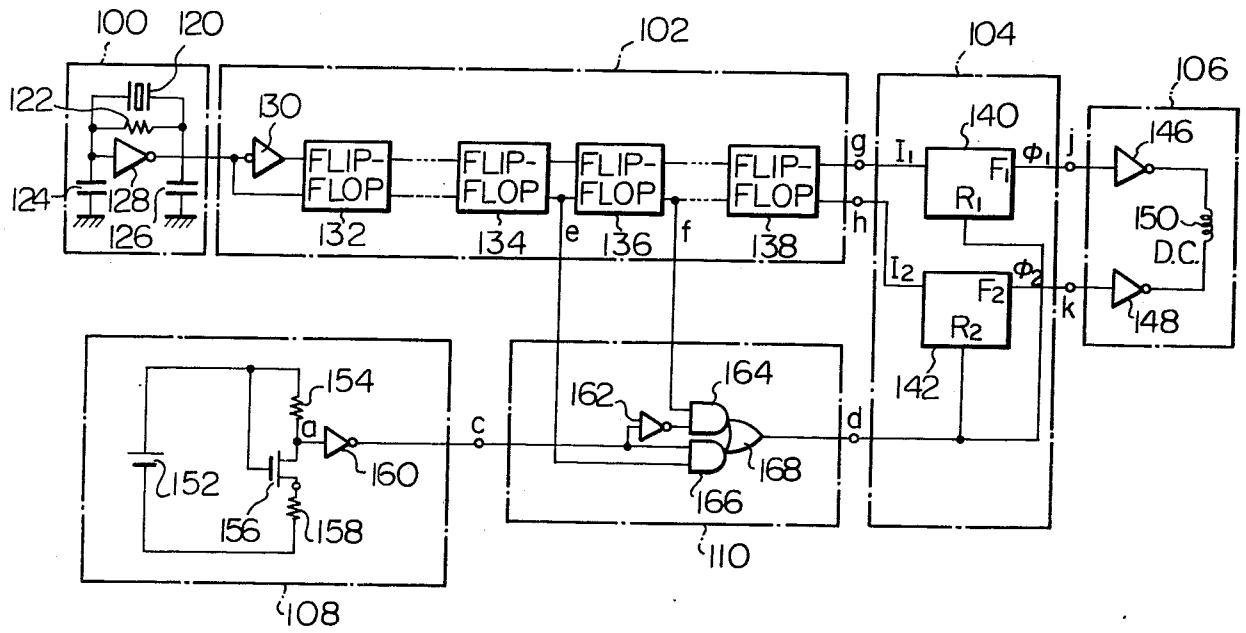
FIG. 10 is a circuit diagram which shows in detail the detail circuitry of the embodiment illustrated in FIG. 9.

FIG. 10 shows a detailed circuitry for the circuit of FIG. 9 in more detail. In oscillator 100, reference numeral 120 represents a quartz crystal, 122 a feedback resistor, 128 an inverter, and 124, 126 denote capacitors. In frequency divider 102, reference numeral 130 designates an inverter, and 132, 134, 136, 138 denote flip-flops (hereafter referred to as FF). In wave shaping, circuit 104, reference numerals 140, 142 denotes flip-flops; in driver circuit 106, numerals 146, 148 designate inverters and 150 a driving coil; in voltage detection circuit 108, numeral 152 represents a battery, 154, 158 denote resistors, 156 a P-channel metal oxide field effect transistor, and 160 an inverter; and in change-over circuit 110, reference numeral 162 denotes an inverter, 164, 166 AND gates, and 168 an OR gate.

Figure 11:
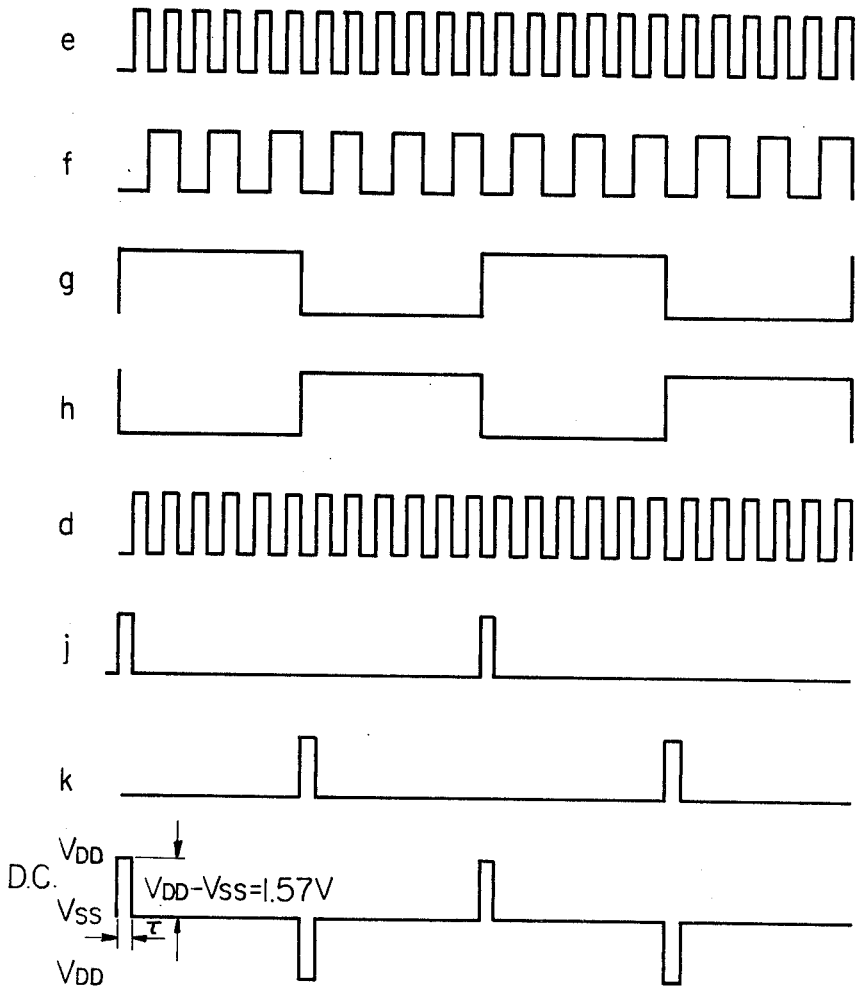
FIG. 11 shows waveforms for operation during normal battery voltage.

FIG. 11 and FIG. 12 show relevant waveforms, with FIG. 11 showing the waveforms for normal operation at normal voltage, and FIG. 12 showing the waveforms for operation when there is a drop in voltage.

Figure 13:
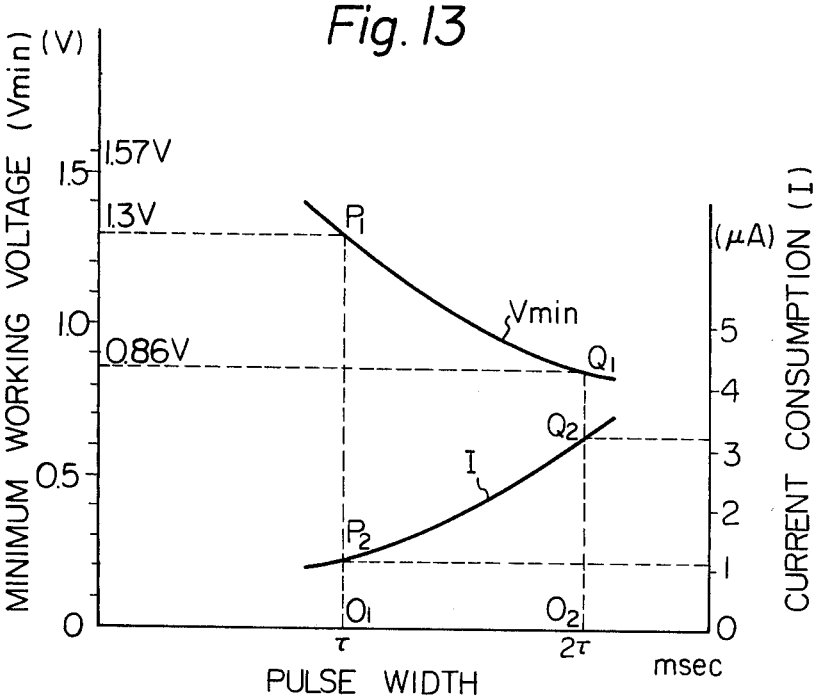
FIG. 13 shows driving current and minimum working voltage plotted against driving pulse width.

FIG. 13 shows current consumption and minimum working voltage for a driving coil plotted against driving pulse width.

Figure 14:
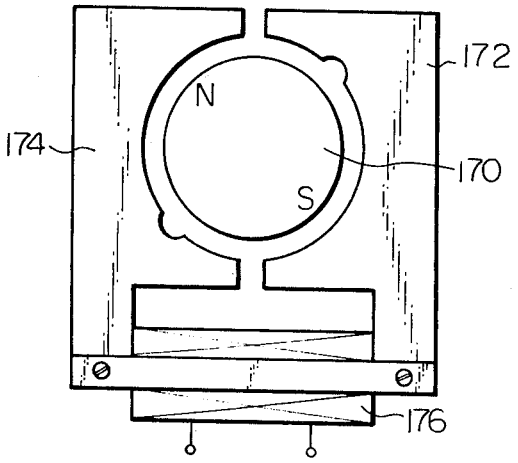
FIG. 14 is a plan view of another example of a stepping motor adapted to be driven by the circuit shown in FIG. 10.

FIG. 14 illustrates a stepping motor as an embodiment of an electro-mechanical transducer, in which reference numeral 170 denotes a rotor which is fabricated from a magnet, 172, 174 designate stators which consist of a magnetic material, and 176 is a driving coil.

in the conventional transducer driver circuit (not shown), the width of the alternating pulses obtained from wave shaping circuit is normally fixed at approximately 8 msec (milli-seconds). This corresponds to point $O_2$ in FIG. 13, where the current consumption at the rated voltage of 1.57v is greater than 3 $\mu$A (milliamps), a fairly large figure.

Referring to FIG. 10, if the rated voltage of battery 152 is 1.57v, a high potential will appear at point a of voltage detection circuit 108 and the output c of inverter 160 will assume a "1" logic level. Output signal e produced by FF 134 of frequency divider 102 and output signal f obtained from FF 136 are fed to change-over circuit 110 at the output terminal d of which appears the output of FF 134, as can be seen in FIG. 11. This signal is applied to terminal R1 of FF 140 and terminal R2 of FF 142, both of which are located in wave-shaping circuit 104. On the other hand, the output g of frequency divider 102 is applied to input terminal $I_1$ of FF 140 and input terminal $I_2$ of FF 142 so that pulses having a pulse width $\tau$, i.e., half the period of the FF 134 output, appear alternately at the output terminals j, k of FF 140 and FF 142, respectively, as may be appreciated from FIG. 11. These pulses are applied to inverters 144, 146 of driver circuit 106, causing an alternating current to flow through driving coil 150 which rotates the transducer in a step-wise fashion. This corresponds to point $O_1$ in FIG. 13 and represents current consumption which is $\frac{1}{3}$ of the conventional example, or approximately 1.2 $\mu$A, an extremely small value. The minimum working voltage corresponding to this pulse width is 1.3 v, so that the transducer will cease operating for a voltage below this value; however, since the voltage detection circuit detects a voltage drop before the 1.3 v value is attained and causes the pulse width to widen, it is possible to actuate the stepping motor with a lower working voltage.

Many concrete examples of voltage detection circuits have been proposed in prior art so a detailed description of them shall be omitted here. However, with regard to the voltage detection circuit of FIG. 10, the voltage at point a is lower than the threshold voltage of inverter 160 when the battery is operating at its rated voltage; accordingly, the output c of the inverter assumes the logic level of "1." However, when the battery voltage falls to a preset value at which operation would be impossible, the voltage at point a exceeds the threshold voltage and the output c assumes a "0" logic level so as to switch the output of change-over circuit 110. The detection voltage level of the battery voltage can be optionally set by changing the values of resistors 154, 158; it is also possible to maintain a high level of detection precision by combining a plurality of detection circuits which are set to a variety of values.

If it is assumed that detector 108 is set to detect a voltage of 1.4 v, point c will assume a "038 logic level when the battery voltage drops below 1.4 v, as described above. Hence, the output f of frequency divider FF 136 appears at output terminal d of change-over circuit 110, as shown in FIG. 12. Accordingly, pulses having a pulse width $2\tau$, i.e., twice that during normal operation, appear alternately at the output terminals j, k of FF 140, 142, and are applied to the driver circuit. This corresponds to point $O_2$ in FIG. 13 and represents a minimum working voltage of less than 0.9 v. Although the mercury oxide battery previously mentioned can deliver an electromotive force at an environmental temperature of $-10°$, the deliverable voltage will be approximately 1.1 v. However, operation can continue unimpaired even at this low temperature since it is possible for the transducer to operate down to a voltage of 0.9 v by virtue of the fact that the pulse width has been doubled. Furthermore, even if there is a drop in battery voltage from a cause other than low temperature, i.e., such as a drop due to an aged battery, operation can continue down to a fairly low voltage due to the doubled pulse width.

For a case in which there has been a drop in electromotive force due to low temperature, the output signal c of voltage detection circuit 108 will return to a "1" logic level if the voltage of the battery returns to a value of at least 1.4 v as the result of a restoration of normal temperature. Accordingly, the output e of frequency divider FF 134 appears at the output d of change-over circuit 110 and is applied to FF 140, 142 of wave shaping circuit 104, whereby the width of the pulses which appear at terminals j, k is returned to a normal pulse width of $\tau$.

In the above embodiment, pulse width is doubled when there is a drop in voltage; however, it is also possible to vary the pulse width in a step-wise manner responsive to the voltage drop so as to maintain the driving current (peak current pulse width) at a constant level. In addition, the width of the transducer driving pulse during normal operation is held to less than 8 msec so that current consumption is approximately 1 $\mu$A. On the other hand, by widening the pulse width responsive to a drop in battery voltage, the minimum working voltage can be lowered so as to assure operation even at low temperatures. It is also possible to extend the operational lifetime of a battery that has been used for a long period of time. Further reductions in timepiece size can be obtained since it is not necessary to employ batteries which possess a large current capacity.

While the present invention has been shown and described with reference to particular embodiments by way of example, it should be noted that various other changes or modifications may be made without departing from the scope of the present invention.

What is claimed is:

1. A driver circuit for an electro-mechanical transducer of an electronic timepiece having an oscillator circuit providing a relatively high frequency signal and a frequency divider to divide down the relatively high frequency signal to provide a low frequency signal, said driver circuit comprising:

a driving coil for driving said electro-mechanical transducer;

means for detecting an induced voltage of said driving coil and producing an output signal when said induced voltage decreases below a predetermined value; and a pulse width change-over circuit connected to said frequency divider and responsive to said low frequency signal to provide first driving pulses of a first pulse width to energize said driving coil when said induced voltage is above said predetermined value;

said pulse width change-over circuit including means for providing second driving pulses of a second pulse width larger than said first pulse width to energize said driving coil in response to said output signal to compensate for a decrease in said induced voltage below said predetermined value.

2. A driver circuit according to claim 1, in which said detecting means comprises a first induced voltage detection inverter connected to one end of said driving coil, and a second induced voltage detection inverter connected to the other end of said driving coil.

3. A driver circuit according to claim 2, in which said detecting means further comprises memory circuit means responsive to outputs of said first and second induced voltage detection inverters to provide said output signal.

4. A driver circuit according to claim 2, in which at least one of the ends of said driving coil is connected to ground through a MOS transistor.

5. A driver circuit for an electro-mechanical transducer of an electronic timepiece powered by a battery and having an oscillator circuit providing a relatively high frequency signal, and a frequency divider to divide down the relatively high frequency signal to provide first and second low frequency signals, said driver circuit comprising:

a driving coil to drive said electro-mechanical transducer;

a voltage detection circuit adapted to be connected to said battery for detecting an output voltage thereof to provide an output signal when said output voltage decreases below a predetermined level;

a waveform shaping circuit responsive to said first low frequency signal to provide first driving pulses of a first pulse width to energize said driving coil when said output voltage is above said predetermined value; and said waveform shaping circuit including means for providing second driving pulses of a second pulse width larger than said first pulse width to energize said driving coil in response to said output signal and said second low frequency signal to compensate for a decrease in said battery below said predetermined value.

6. A driver circuit according to claim 5, further comprising a change-over circuit composed of gate means connected to said frequency divider for normally passing said first low frequency signal to said waveform shaping circuit whereby said waveform shaping circuit produces said first driving pulses in the absence of said output signal, said gate means being responsive to said output signal from said voltage detection circuit for passing said second low frequency signal to said waveform shaping circuit whereby said waveform shaping circuit produces said second driving pulses.

7. A driver circuit according to claim 6, in which said waveform shaping circuit comprises flip-flops having their input terminals connected to a final stage of said frequency divider, said flip-flops being connected at their reset terminals to said change-over circuit to receive one of said first and second low frequency signals.

* * * * *